United States Patent [19]

Noma et al.

[11] Patent Number: 4,612,777

[45] Date of Patent: Sep. 23, 1986

[54] HUMIDIFIER UNIT FOR REFRIGERATED DISPLAY CABINETS

[75] Inventors: Kouichi Noma, Ota; Kazuto Matsuda, Gunma; Toshio Sakurai, Ashikaga, all of Japan

[73] Assignees: Sanyo Electric Co., Ltd.; Tokyo Sanyo Electric Co., Ltd., both of Japan

[21] Appl. No.: 634,801

[22] Filed: Jul. 26, 1984

[30] Foreign Application Priority Data

| | | | |
|---|---|---|---|
| Jul. 27, 1983 | [JP] | Japan | 58-138141 |
| Aug. 10, 1983 | [JP] | Japan | 58-124568[U] |
| Aug. 18, 1983 | [JP] | Japan | 58-150585 |
| Oct. 11, 1983 | [JP] | Japan | 58-157599[U] |

[51] Int. Cl.[4] ..... A47F 3/04

[52] U.S. Cl. ..... 62/247; 261/118; 261/DIG. 48

[58] Field of Search ..... 62/247; 261/DIG. 48; 98/30, 105; 261/118

[56] References Cited

U.S. PATENT DOCUMENTS

| | | | |
|---|---|---|---|
| 2,066,312 | 1/1937 | Bales | 62/247 X |
| 3,996,763 | 12/1976 | Karashima | 62/256 |
| 4,257,989 | 3/1981 | Nishikawa | 261/DIG. 48 X |
| 4,266,951 | 5/1981 | Calvert | 261/118 X |

*Primary Examiner*—William E. Tapolcai

*Attorney, Agent, or Firm*—Darby & Darby

[57] ABSTRACT

A humidifier unit for use with a refrigerated display cabinet having a cooled air passage includes a body adapted to be mounted on an upper surface of the refrigerated display cabinet, a horizontally elongate atomizing water tank disposed in one side of the body and having a plurality of ultrasonic vibrators mounted on a bottom thereof and arrayed in a longitudinal direction, an air blower disposed in an opposite side of the body for supplying air drawn from a suction port into the atomizing water tank, and pipes angularly movably mounted on the atomizing water tank in coaction with the ultrasonic vibrators, respectively, for transferring a mist generated by the ultrasonic vibrators in the atomizing water tank and air from the air blower into the cooled air passage of the refrigerated display cabinet.

8 Claims, 18 Drawing Figures

HUMIDIFIER UNIT FOR REFRIGERATED DISPLAY CABINETS

BACKGROUND OF THE INVENTION

1. Field of the Invention

The present invention relates to a humidifier unit for a refrigerated display cabinet, and more particularly to a humidifier unit for humidifying cooled air in a refrigerated display cabinet to preserve fresh produce stored in the display cabinet for a long period of time.

2. Description.of the Prior Art

U.S. Pat. No. 4,179,900 discloses an apparatus for preserving fresh produce displayed on shelves in a refrigerator for an extended period of time by supplying mist from a plurality of nozzles positioned above the shelves to the produce articles being displayed. However, the disclosed preserving apparatus have had the following disadvantages:

(1) A uniform supply of mist over the produce articles on the shelves requires a certain number of fixed nozzles which need a complicated piping that is expensive.

(2) The nozzles should preferably be located in an upper central position over the shelves. The inlet pipes thus extend from behind the refrigerator cabinet to the nozzles in the refrigerator cabinet, and such a piping system is unsightly to view. The piping system reduces the storage space in the refrigerator cabinet. If large produce articles are placed on the shelf directly below the nozzles, then only such large articles are humidified, but other articles are supplied with little or no mist.

(3) Where the inlet pipes extending to the nozzles in the refrigerator cabinet are long, there is a tendency for water in the pipes to get frozen when the mist is not supplied for a long interval of time. If this happens, then the apparatus cannot be actuated until after the ice in the pipes is thawed.

(4) Since the mist is supplied from the nozzles, mist particles are relatively large, and cannot be spread uniformly over a wide area.

There has been proposed to use an ultrasonic humidifier to solve the above drawback (4). The ultrasonic humidifier which preserves fresh produce for a long period of time by humidifying the interior of a refrigerator is operated through the year irrespectively of the seasons. To increase the durability in operation, the ultrasonic humidifier has an atomizing water tank made of stainless steel sheet. The ultrasonic humidifier has an ultrasonic vibrator energized by a transistor including an outer surrounding collector held in direct contact with a cooling plate attached to an outer side wall surface of the atomizing water tank for radiating heat from the transistor and preventing noise. Therefore, the wall of the water tank and the electrode surface of the ultrasonic vibrator which is in contact with the water are electrically connected to each other. Since the natural potential of the stainless steel tank wall is lower than that of an Ni-plated layer on the electrode surface, the following chemical reaction takes place:

$$Ni \rightarrow Ni^{++} + 2e^{-}$$

so that Ni is dissolved due to galvanic corrosion. The ultrasonic vibrator is then deteriorated at such a rate that it will become inoperative after about 1,000 hours of use. Therefore, the ultrasonic vibrator has to be replaced at frequency intervals regardless of the fact that atomizing water tank is made of stainless steel for increased durability.

SUMMARY OF THE INVENTION

It is a first object of the present invention to provide a humidifier unit which is substantially free from any influence of cooled air and will operate for good humidifying action.

A second object of the present invention is to discharge mist from a humidifier unit efficiently out of a discharge outlet into a cooled air passage.

A third object of the present invention is to humidify the interior of a refrigerated display cabinet uniformly and thoroughly with mist spread entirely in the display cabinet.

A fourth object of the present invention is to provide a humidifier unit which can easily be installed on an existing refrigerated display cabinet.

A fifth object of the present invention is to provide an ultrasonic humidifier unit having an atomizing water tank of stainless steel sheet and capable of preventing galvanic corrosion of the electrode surface of an ultrasonic vibrator, resulting in an increased degree of durability of the humidifier unit.

According to the present invention, there is provided a humidifier unit for use with a refrigerated display cabinet, comprising a body adapted to be mounted on an upper surface of the refrigerated display cabinet, a horizontally elongate atomizing water tank disposed in one side of the body and having a plurality of ultrasonic vibrators mounted on a bottom thereof and arrayed in a longitudinal direction, an air blower disposed in an opposite side of the body for supplying air drawn from a suction port into the atomizing water tank, and pipes angularly movably mounted on the atomizing water tank in coaction with the ultrasonic vibrators, respectively, for transferring a mist generated by the ultrasonic vibrators in the atomizing water tank and air from the air blower into the cooled air passage of the refrigerated display cabinet.

The mist is generated by the ultrasonic vibrators in the atomizing water tank and delivered through the rotatable pipes into the cooled air passage of the refrigerated display cabinet. Therefore, the mist can be produced in a place remote from the cooled air passage without being affected by cooled air in the cooled air passage. Since a mist rather than water is delivered into the cooled air passage, any influence (a freeze) due to the cooled air can be reduced, and the construction is inexpensive to manufacture.

Further according to the present invention, there is provided a humidifier unit for use with a refrigerated display cabinet in which the pipes are composed of a plurality of outlet pipes mounted in coaction with the ultrasonic vibrators, respectively, for transferring a mist generated by the ultrasonic vibrators in the atomizing water tank and air from the air blower out of the atomizing water tank, and communicating pipes having ends connected to the outlet pipes, respectively, and opposite ends to the cooled air passage of the refrigerated display cabinet, the outlet pipes comprising bent pipes having connector mouths opening laterally and angularly movably extending through the lid plate closing an upper opening of the atomizing water tank.

The pipes are bent in given directions and held in communication with spaced locations in the cooled air passage in the refrigerated display cabinet through the communication pipes. With such a piping arrangement, the communication pipes are simple in construction.

Still further according to the present invention, a circuit board supporting circuit components of an ultrasonic oscillator for actuating the above ultrasonic vibrators is fixed to a cooling plate secured to an outer surface of a side wall of the atomizing water tank, the circuit components including an oscillation output element fixed to the cooling plate in spaced relation to the circuit board and insulated from the wall of the atomizing water tank.

Still further according to the present invention, there is provided a refrigerated display cabinet comprising a heat insulating wall having one open side and an inner wall surface, a partition defining a storage chamber, the inner wall surface and the partition jointly defining a cooled air passage, a refrigerating unit and an air blower disposed in the cooled air passage, the cooled air passage including an outlet and an inlet confronting each other and disposed upwardly and downardly of the one open side, an apertured straightening plate disposed transversely in the cooled air passage in the vicinity of the outlet, a humidifier unit mounted on an upper surface of the heat insulating wall, and a pipe for delivering a mist generated by the humidifier unit, the pipe having an outlet port opening in the cooled air passage in the vicinity of the straightening plate upstream thereof.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
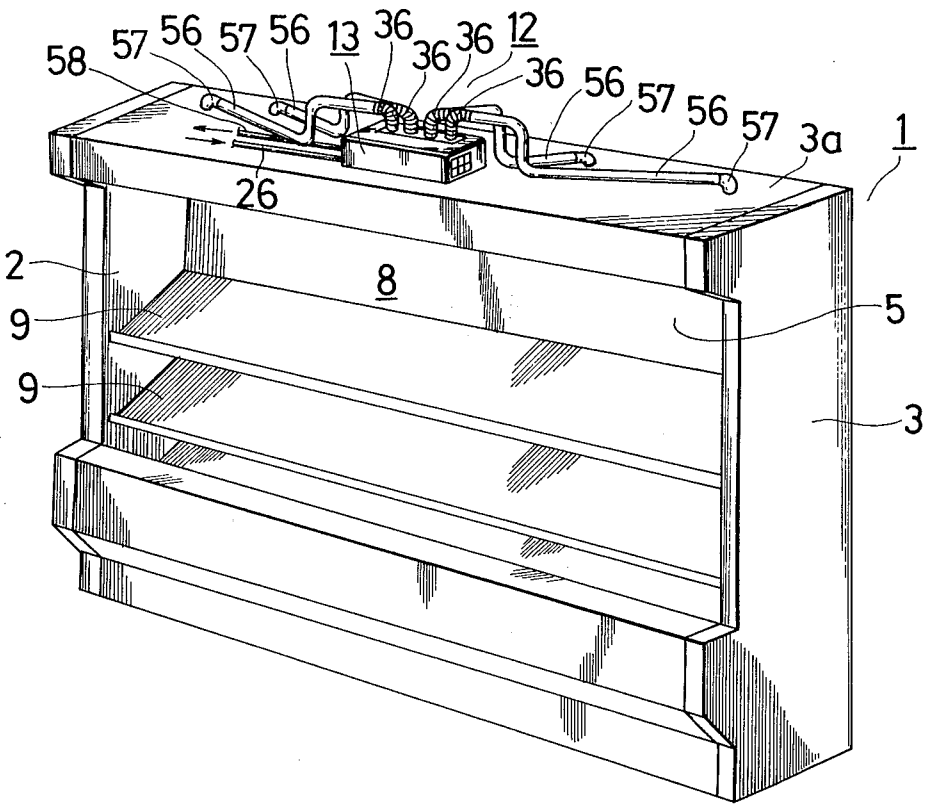
FIG. 1 is a perspective view of a refrigerated display cabinet with a humidifier unit of an embodiment of the present invention is attached thereto.
Figure 2:
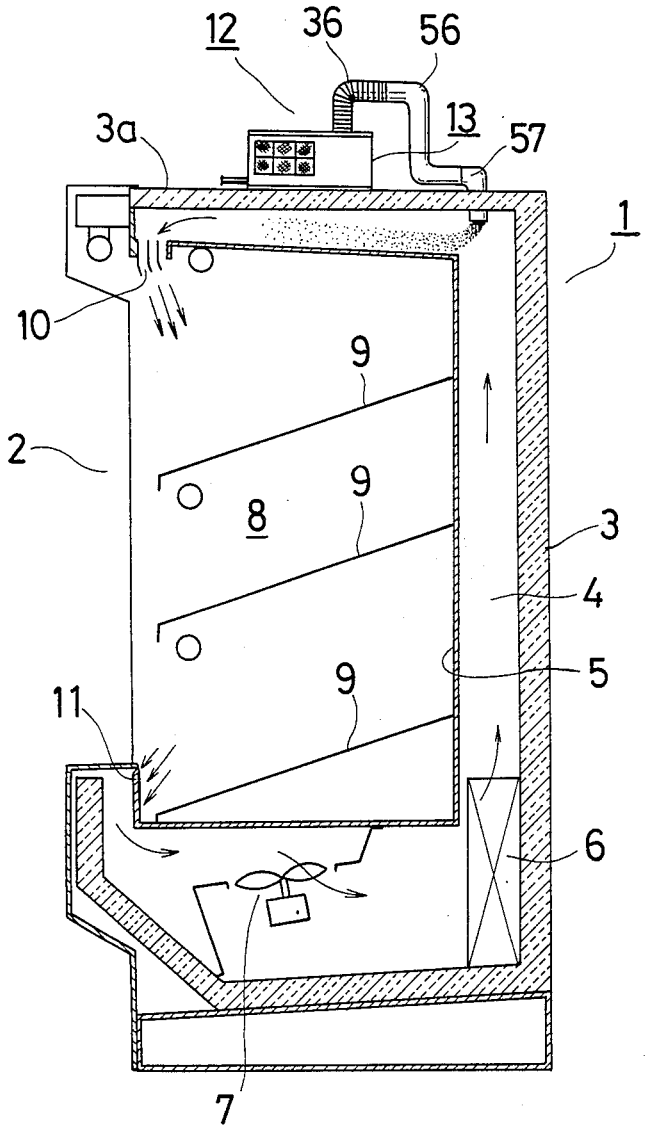
FIG. 2 is a vertical cross-sectional view of the refrigerated display cabinet shown in FIG. 1.

As shown in FIGS. 1 and 2, a refrigerated display cabinet 1 has a front opening 2 and includes a heat insulating wall 3 and a partition plate 5 which define therebetween a cooled air passage 4. The refrigerated display cabinet 1 has a refrigerator unit 6 and an air blower 7 which are disposed in a lower space of the cooled air passage 4, and a plurality of vertically spaced shelves 9 disposed in a storage chamber 8 surrounded by the partition plate 5. The cooled air passage 4 has a discharge outlet 10 and a suction inlet 11 which are positioned upwardly and downwardly, respectively, of the front opening 2. Air as cooled by the refrigerator unit 6 is forcibly circulated by the air blower 7 in the direction of the arrows to cool the interior of the storage chamber 8 and form an air curtain across the front opening 2. A humidifier unit 12 is mounted on the display cabinet 1.

The humidifier unit 12 will be described with reference to FIGS. 3 through 8. The humidifier unit 12 has an elongate hollow casing body 13 composed of a surrounding side wall 14, an upper plate 15, and a bottom plate 16. The surrounding side wall 14 includes lateral side walls **14*a*, 14*b* having bent flanges 17, 17 by which the casing body 13 is fixed to an upper surface 3*a* of the display cabinet 1, the flanges 17 having screw holes 18, 18. The humidifier unit 12 includes an atomizing water tank of stainless steel sheet disposed in one side of the casing body 13 with upper flanges 20, 20 spot-welded to the underside of the upper plate 15. The atomizing water tank 19 has an upper opening and is of a substantially rectangular, elongate shape when viewed in plan. The water tank 19 includes a bottom plate 19*a* having four through holes 22 defined therein at spaced intervals in a longitudinal direction and through which ultrasonic vibrators 21 are directed toward the water tank 19. The ultrasonic vibrators 21 are mounted on the lower surface of the bottom plate 19*a* respectively in alignment with the through holes 22. The ultrasonic vibrators 21 are driven respectively by ultrasonic oscillators 23 mounted in heat transfer relation on a front wall of the water tank 19 for generating water columns 24 (FIG. 7) to produce a mist of fine water particles. Water is supplied from a water supply system pipe 26 through a water supply pipe 25 having a solenoid-operated valve 27 disposed in the casing body 13 and a water supply port 25' opening into the water tank 19 at an upper portion near one end thereof. A first float switch 28 is disposed in one end of the water tank 19 for detecting a water shortage in the water tank 19 in response to downward movement of the float to de-energize the ultrasonic vibrators 21, which will be prevented from being damaged due to vibration under no load. A second float switch 29 is disposed in the other end of the water tank 19 for opening the solenoid-operated valve 27 when a water level in the water tank 19 is lowered beyond a certain level position to supply humidifying water into the water tank 19 through the water supply port 15'. An overflow pipe 30 is vertically mounted in the water tank 19 and has an upper open end positioned substantially centrally in the water tank 19 for allowing an overflow of water therethrough when the water level is raised beyond the given level position at the time the solenoid-operated valve 27** malfunctions.

The upper opening of the water tank 19 is closed by a lid plate 31 from which depends partition plates 32, 33 for preventing water waves generated by the actuation of the vibrators 21 from affecting the float switches 28, 29. The lid plate 31 has four circular holes 34 defined therein at positions inward of the partition plates 32, 33 in alignment with the vibrators 21. The lid plate 31 is removably attached by screws 35 to upper inward lips 20' on the ends of the water tank 19. Hollow cylindrical outlet pipes 36 depend from the water tank 19 in vertical alignment with the vibrators 21 and have lower ends fitted respectively in the circular holes 34 in the lid plate 31. Each of the outlet pipes 36 has a plurality of annular ridges 37 formed on an outer periphery as bellows, where the outlet pipe 36 is flexible and bent into a substantially inverted L shape with an upper connector mouth 38 opening laterally. A resilient seal gasket 39 such as an O-ring is fitted over each of the outlet pipes 36 and sandwiched between the upper surface of the lid plate 31 around the circular hole 34 and the lowermost annular ridge 37 of the outlet pipe 36 for preventing any leakage of the mist from the water tank 19 through the circular hole 34. A retaining plate 40 is fastened by screws 41 to vertical members 31*a* of the lid plate 31 and has four recesses 42 with their edges engaging in grooves 37' between adjacent annular ridges 37 of the outlet pipes 36 so that the outlet pipes 36 extending through the lid plate 31 are prevented from being pulled out. Each outlet pipe 36 is freely rotatable as indicated by the arrows in FIG. 4.

A cross-flow type air blower 43 is disposed in one side of the casing body 13 opposite to the water tank 19. The air blower 43 is composed of a fan case 44, a cross-flow fan 45, and a motor 46 for driving the fan 45. The air blower 43 draws air through a filter 48 in a suction port 47 defining in a righthand side wall (in FIG. 6) of the casing body 13, introduces air through a lower wall of the fan case 44 into the fan case 44, and supplies such air under pressure through a discharge port 49 into the water tank 19. A power supply transformer 50 is disposed between the suction port 47 and the air blower 43 and is cooled by an air current drawn into the fan case 44.

Figure 7:
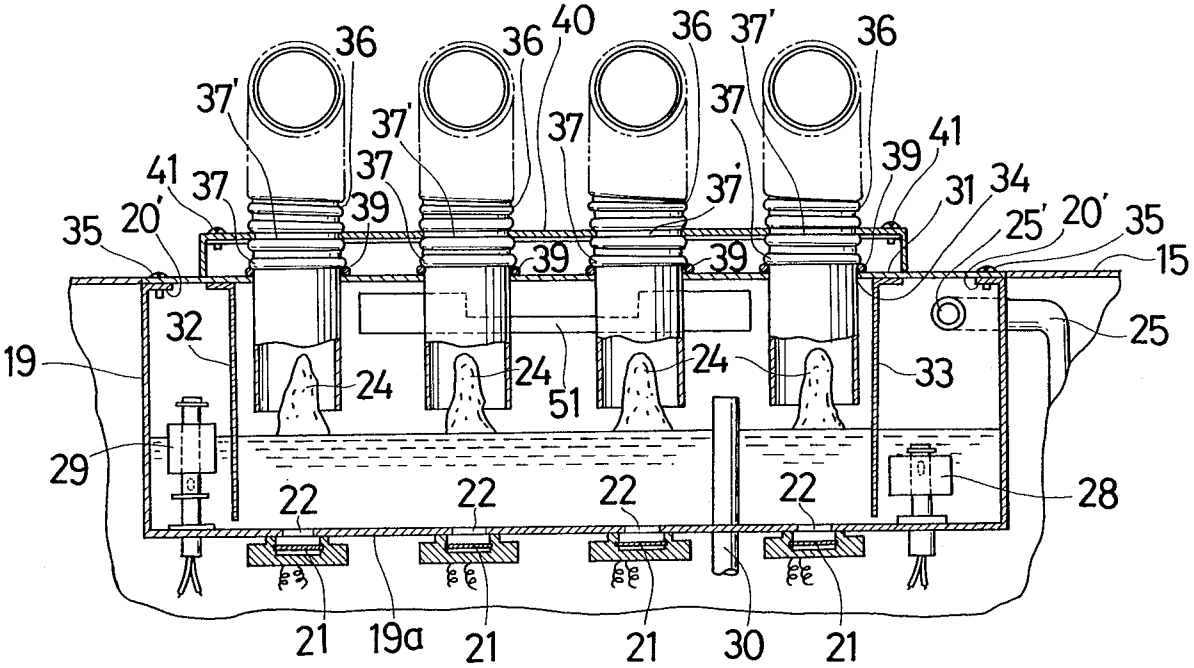
FIG. 7 is a fragmentary cross-sectional view of an atomizing water tank of the humidifier unit of FIG. 1.
Figure 8:
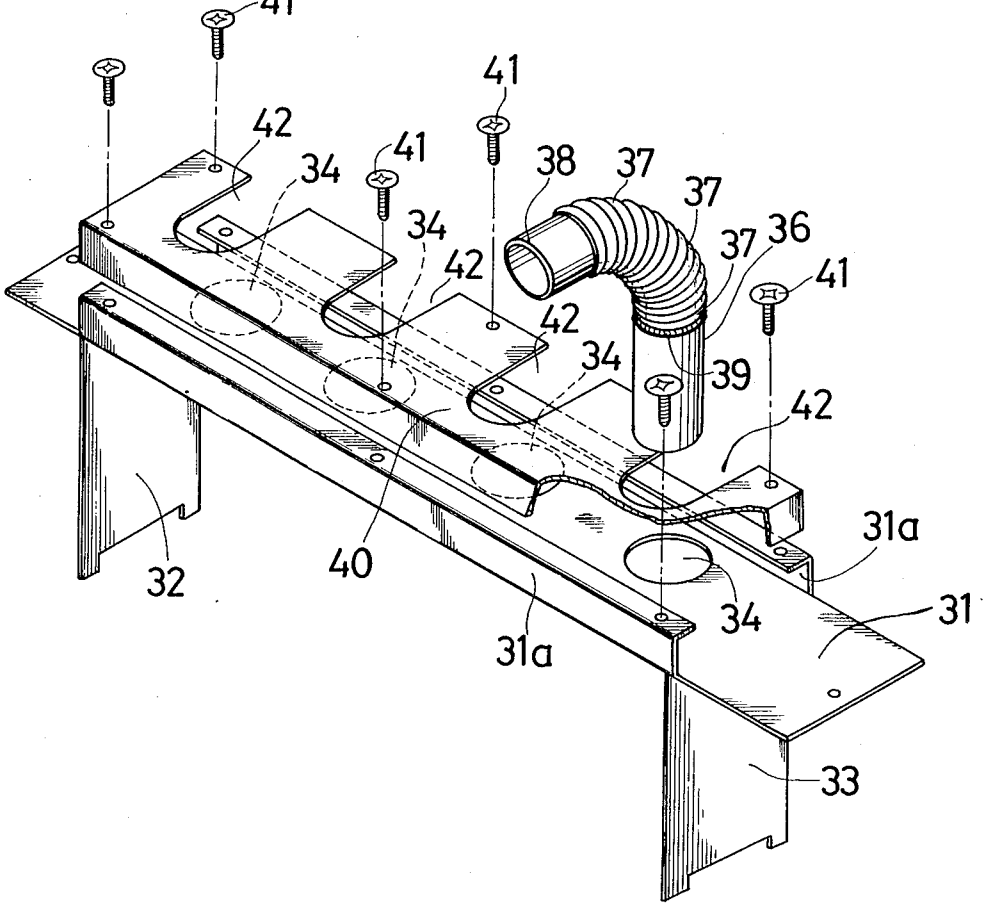
FIG. 8 is an exploded perspective view, partly broken away, of a lid plate of the humidifier unit of FIG. 1.

An air inlet port 51 is defined in an upper portion of a lateral wall portion of the water tank 19 in alignment with the discharge port 49 at a position above the lower open ends of the outlet pipes 36. As illustrated in FIG. 7, the air inlet port 51 is of a horizontally elongate shape having end portions vertically wider than a central portion thereof. A horizontal guide plate 52 is positioned slightly downwardly of the air inlet port 51 and between the water tank 19 and the discharge port 49 of the air blower 43. Vertical guide plates 53, 53 are mounted on the horizontal guide plate 52 and progressively diverge away from each other from the discharge port 49 toward the air inlet port 51. The vertical guide plates 53 and the horizontal guide plate 52 jointly define an air flow passage X between the air blower 43 and the water tank 19. Designated at 54 is a power supply plug, and 55 a power supply switch.

Figure 3:
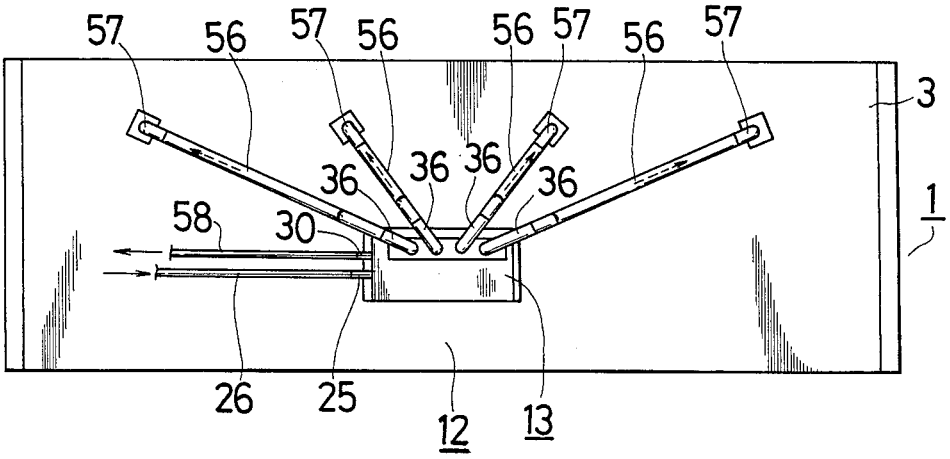
FIG. 3 is a plan view of the refrigerated display cabinet shown in FIG. 1.
Figure 4:
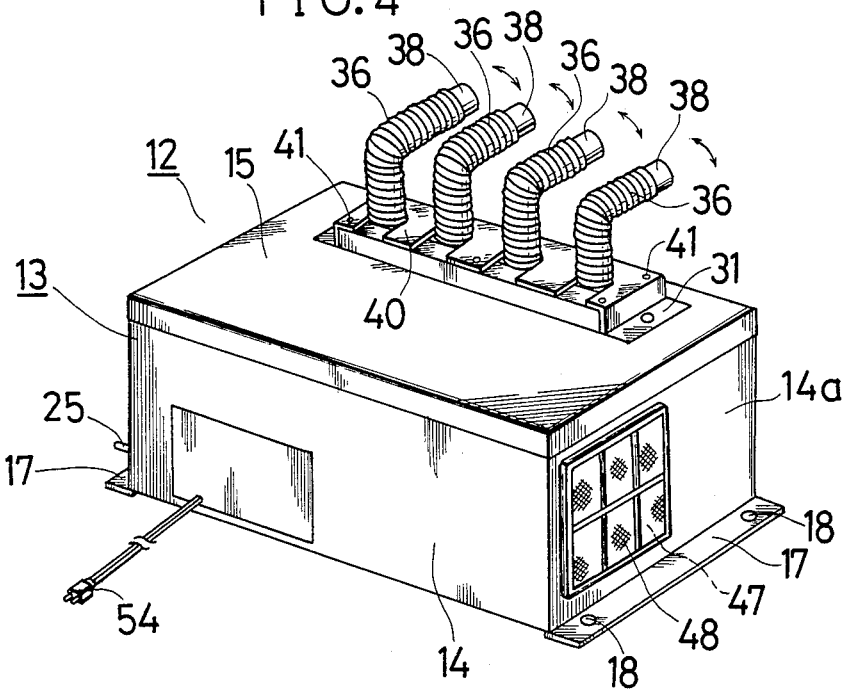
FIG. 4 is a perspective view of the humidifier unit shown in FIG. 1.
Figure 5:
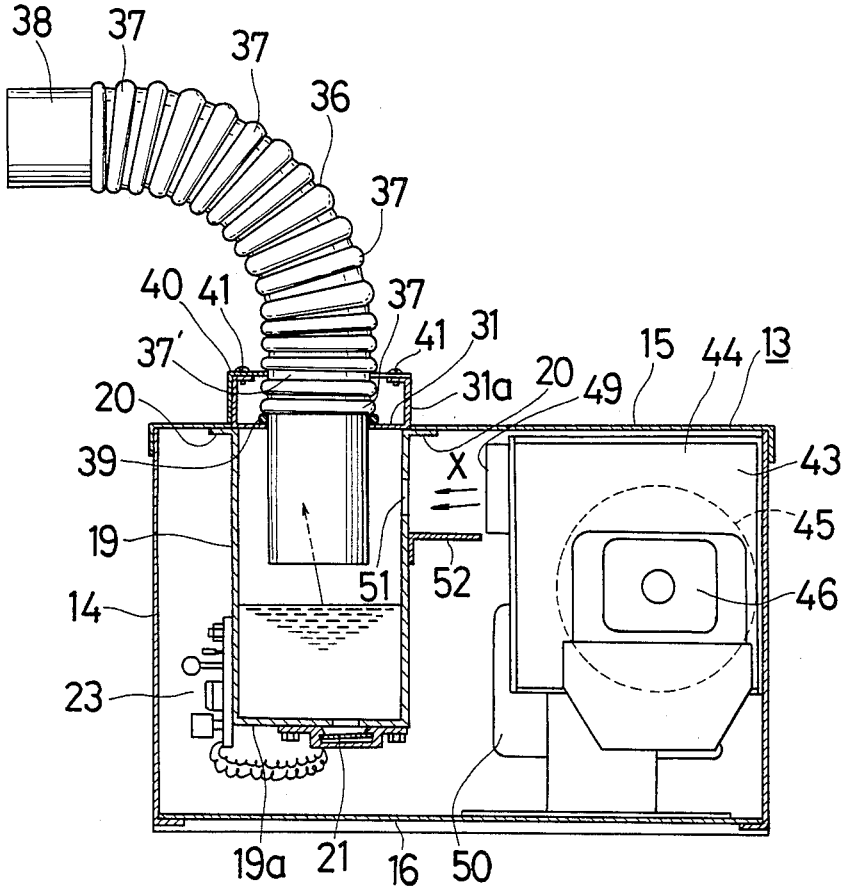
FIG. 5 is a vertical cross-sectional view of the humidifier unit shown in FIG. 1.
Figure 6:
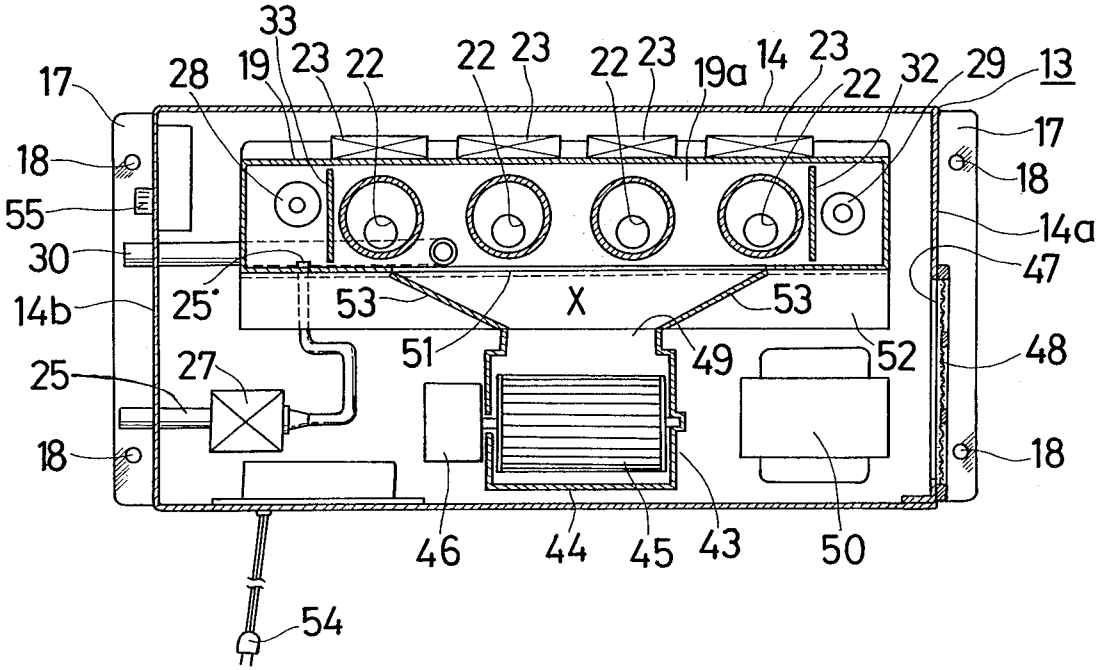
FIG. 6 is a horizontal cross-sectional view of the humidifier unit shown in FIG. 1.

The casing body 13 of the humidifier unit 12 thus constructed is fixedly mounted on the refrigerated display cabinet 1 by screwing the flanges 17 to the upper surface 3*a* of the display cabinet 1 as shown in FIGS. 1 through 3. Then, the outlet pipes 36 are turned to orient the connector mouths 38 in a desired direction, and flexible communication pipes 56 are connected at ends to the connector mouths 38. The other ends of the communication pipes 56 are thereafter connected to pipes 57 extending through the upper portion of the heat insulating wall 3 of the display cabinet 1 at spaced intervals, or are directly inserted in holes defined in the upper portion of the heat insulating wall 3. It is preferable that the communication pipes 56 be held in communication with the cooled air passage 4 at substantially equal horizontal intervals for uniform humidification. The water supply system pipe 26 is connected to the water supply pipe 25, and a water discharge pipe 58 is connected to the overflow pipe 30. The power supply plug 54 is inserted into a plug socket (not shown) on the display cabinet 1 or the like. The humidifier unit 12 has now been installed in place on the display cabinet 1. The humidifier unit 12 can therefore be mounted on an existing refrigerated display cabinet.

Operation of the humidifier unit 12 is as follows: When the power supply switch 55 is turned on, the air blower 43 and the ultrasonic oscillators 23 start being energized to introduce air under pressure from the discharge port 49 of the air blower 43 through the air inlet port 51 into the atomizing water tank 19 and also to cause the ultrasonic vibrators 21 to generate water columns 24 on the water surface. A mist produced around the water columns 24 is transferred by air from the air blower 43 into the outlet pipes 36 through the outlet pipes 36, the communication pipes 56, and the pipes 57 into the cooled air passage 4 in the display cabinet 1, wherein the mist joins the cooled air stream in the cooled air passage 4 and is ejected through the outlet 10 into the storage chamber 8 for humidifying the interior thereof.

As the water level in the water tank 19 is lowered, the second float switch 29 is actuated by a depression of the float to open the solenoid-operated valve 27. Water is then supplied from the water supply pipe 25 into the water tank 19 to increase the water level therein. When the water level in the water tank 19 returns to the desired level position, the second float switch 29 is turned off to close the solenoid-operated valve 27. The above operation is repeated to keep the water level constant in the water tank 19.

If no water is supplied after the water level has dropped below the desired level position due to a malfunction of the solenoid-operated valve 27, the first float switch 28 is actuated to de-energize the oscillators 23 for thereby preventing the vibrators 21 from being subjected to a burnout under no load.

Air flowing from the air inlet port 51 into the water tank 19 can uniformly be supplied into the outlet pipes 36 since the air inlet port 51 is wider at its opposite ends than its central portion so that the amount of air supplied into the outer outlet pipes 36 will not be smaller than that of air supplied into the inner outlet pipes 36.

As the outlet pipes 36 are rotatable, the connector mouths 38 thereof can be oriented in a desired direction to reduce the number of bent portions of the overall mist transfer path as small as possible. Thus, the resistance to the flow of air can be reduced so that the mist can be transferred to a remote location. The humidifier unit can therefore humidify the interior of a large-size refrigerated display cabinet highly efficiently.

A humidifier unit according to another embodiment will be described with reference to FIGS. 9 through 12. The constructions of the refrigerated display cabinet 1 and the humidifier unit 12 are the same as those illustrated in FIGS. 1 through 8, and only those portions which are different from those illustrated in FIGS. 1 through 8 will be described.

Figure 10:
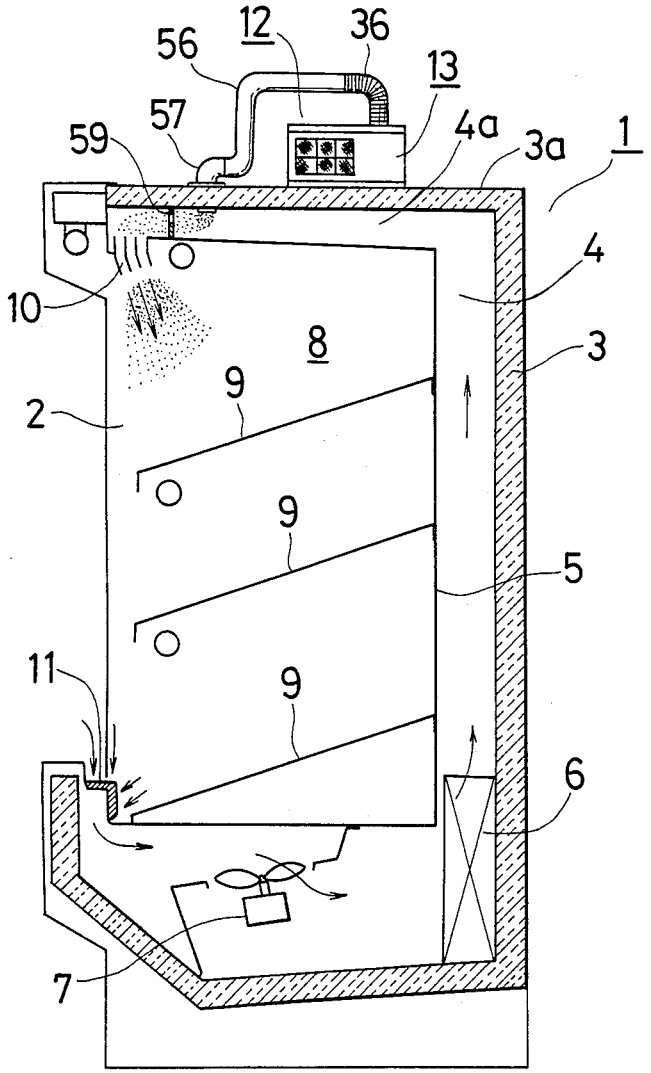
FIG. 10 is a vertical cross-sectional view of the refrigerated display cabinet shown in FIG. 9.
Figure 11:
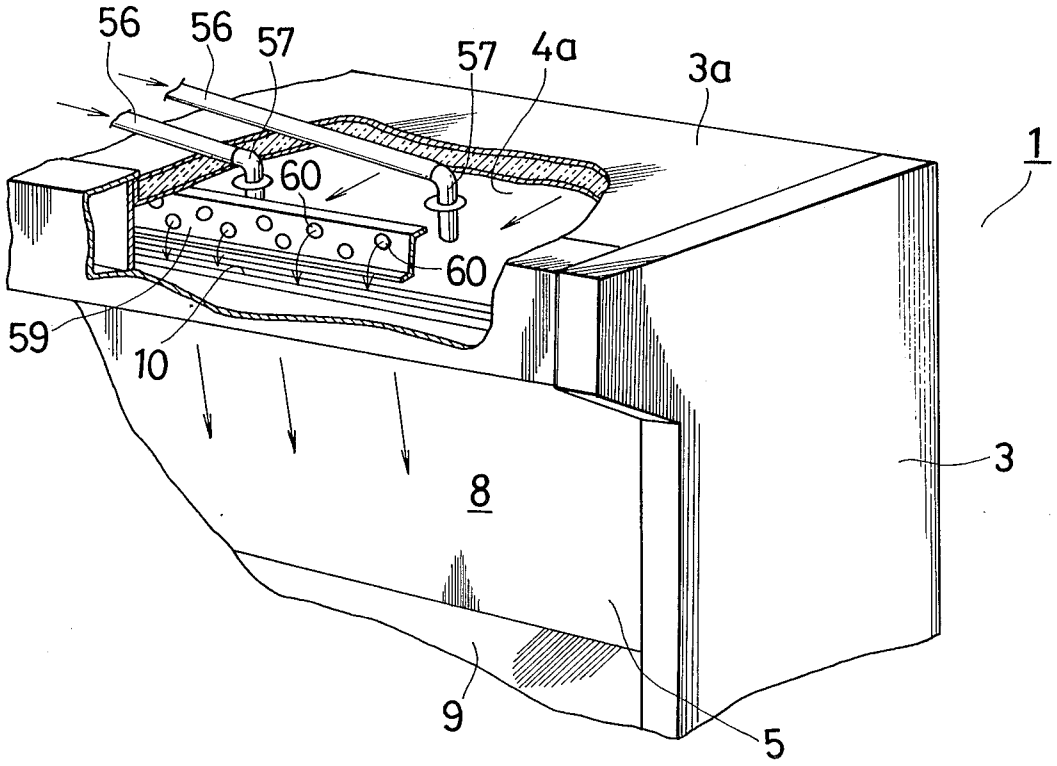
FIG. 11 is a fragmentary perspective view, partly cut away, of the refrigerated display cabinet shown in FIG. 9.

As shown in FIG. 10, a horizontally elongated straightening plate 59 in the form of an apertured plate placed in an upper space 4*a* of the cooled air passage 4 in the vicinity of a position just upstream of the outlet 10. As illustrated in FIG. 11, the straightening plate 59 extends across the cooled air passage 4 to block the flow of air therethrough, and has a number of horizontally oblong holes 60 which are defined at substantially equal intervals and vertically staggered (the holes 60 having the size 25.4 mm×6.4 mm and being spaced about 35 mm for example). The straightening plate 59 serves to uniformize the air flow from the air blower 8 to discharge a uniform flow of cooled air from the outlet 10.

Figure 9:
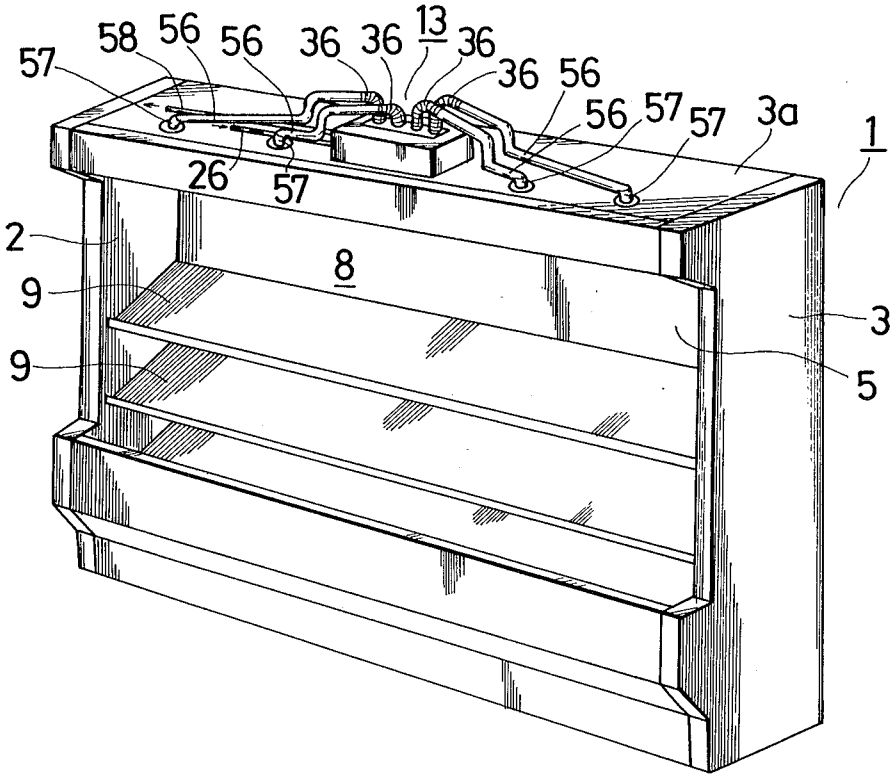
FIG. 9 is a perspective view of a refrigerated display cabinet with a humidifier unit of another embodiment of the present invention is attached thereto.
Figure 12:
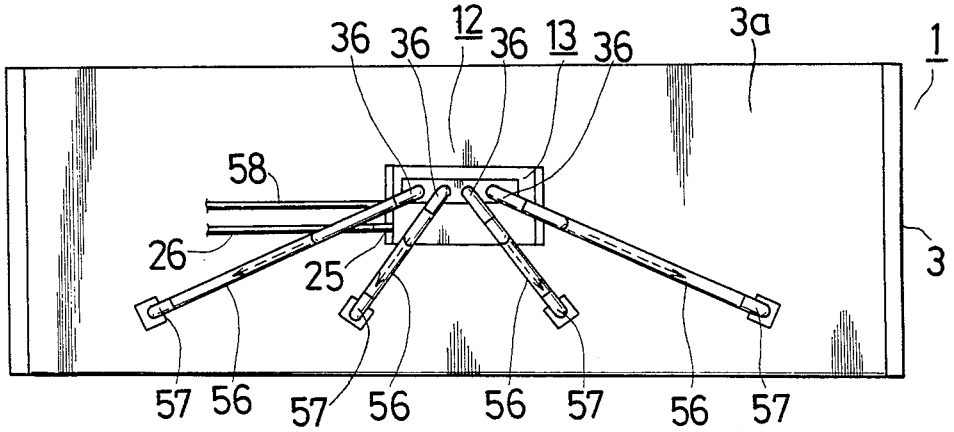
FIG. 12 is a plan view of the refrigerated display cabinet shown in FIG. 9.

As shown in FIGS. 9 and 12, the humidifier unit 12 is fixedly mounted on the refrigerated display cabinet 1 by screwing the flanges 17 to the upper surface 3*a* of the display cabinet 1. Then, the outlet pipes 36 are turned to orient the connector mouths 38 in a desired direction, and the communication pipes 56 are connected at ends to the connector mouths 38. The other ends of the communication pipes 56 are thereafter connected to the pipes 57 with their discharge ports 57*a* opening into the cooled air passage 4 in the vicinity of the straightening plate 59 and upwardly thereof. It is preferable that the pipes 57 open across the cooled air passage 4 at substantially equal horizontal intervals which may be 300–700 mm (for example, about 460 mm) corresponding to the size of the display cabinet for uniform humidification. The water supply system pipe 26 is connected to the water supply pipe 25, and the water discharge pipe 58 is connected to the overflow pipe 30. The power supply plug 54 is inserted into the plug socket (not shown) on the display cabinet 1 or the like. The humidifier unit 12 has now been installed in place on the display cabinet 1.

When the ultrasonic vibrators 21 are energized, there are water columns 24 generated on the water level surface, and a mist produced around the water columns 24 is delivered by the air from the air blower 43 through the outlet pipes 36, the communication pipes 56, and the discharge ports 57*a* of the pipes 57 into the cooled air passage 4 in the vicinity of the straightening plate 59. Air introduced through the inlet 11 into the cooled air passage 4 by the air blower 7 is accelerated therein and is cooled by the refrigerator unit 6 by a heat exchange, the cooled air being then fed upwardly into the upper space 4*a*. The cooled air supplied into the upper space 4*a* is mixed with the mist fed from the humidifier 12, and then the mixed mist is discharged through the holes 60 in the straightening plate 59 uniformly out of the outlet 10 thereby to cool and humidify the interior of the storage chamber 8.

With the straightening plate 59 disposed in and across the cooled air passage 4 in the vicinity of the outlet 10, the cooled air current can be uniformly discharged through the outlet 10 into the storage chamber 8. Since the mist generated by the humidifier 12 is supplied into the cooled air passage 4 in the vicinity of the straightening plate 59, the mist flowing into the cooled air passage 4 will not stay therein but will immediately be discharged through the outlet 10, so that the mist will be prevented from dewing in the cooled air passage 4.

Figure 13:
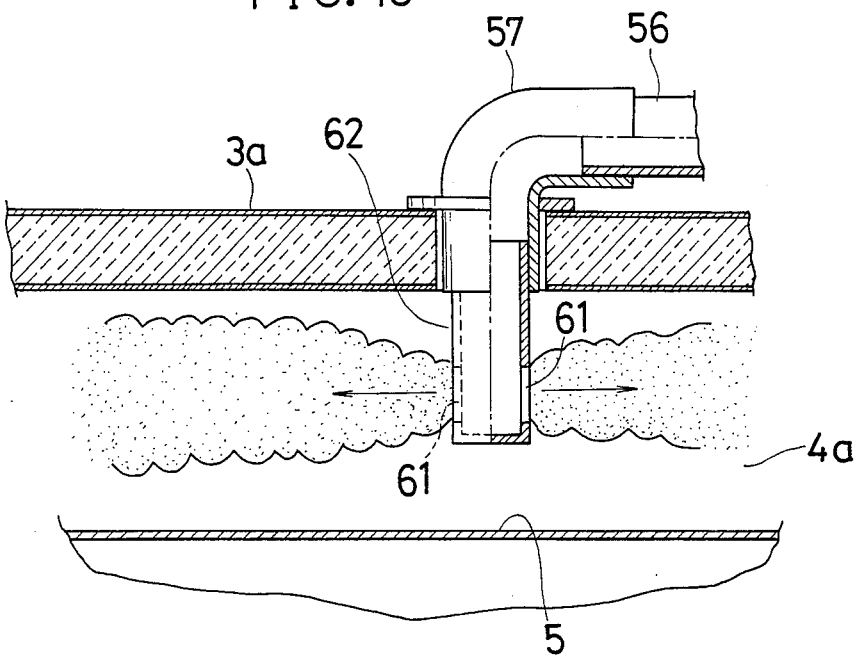
FIG. 13 is a fragmentary vertical cross-sectional view of an upper wall portion of a heat insulating wall of the refrigerated display cabinet shown in FIG. 9.
Figure 14:
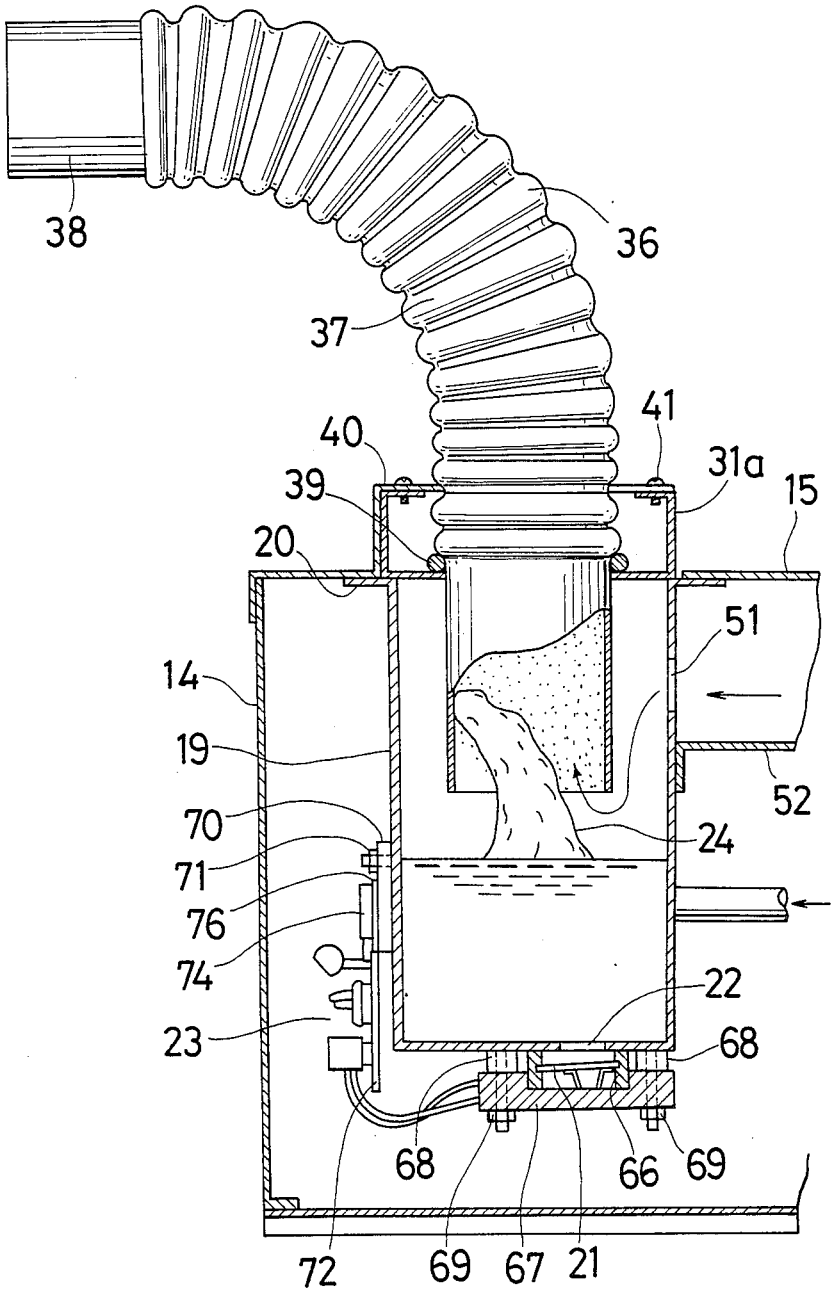
FIG. 14 is a vertical cross-sectional view of the humidifier unit illustrated in FIG. 9.
Figure 15:
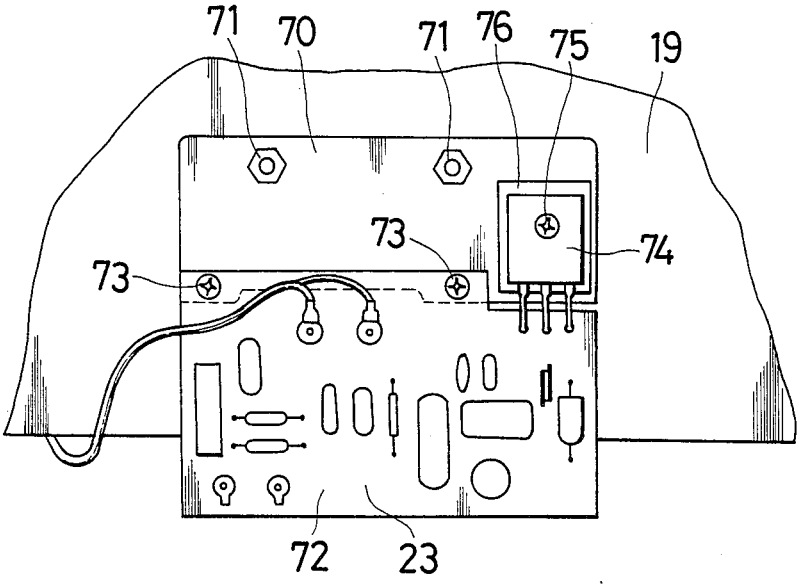
FIG. 15 is a front elevational view of an ultrasonic oscillator of the humidifier unit of FIG. 9.

FIG. 13 illustrates a construction by which a mist from the humidifier 12 can be spread uniformly throughout the storage chamber 8 in the display cabinet 1 for uniform humidification even if the cooled air passage 4 has an increased width.

As shown in FIG. 13, discharge pipes 62 having discharge ports 61 opening transversely of the cooled air passage 4 are connected respectively to the pipes 57. The discharge pipes 62 have closed lower ends with the discharge ports 61 opening laterally when viewed in front elevation. Each of those discharge pipes 62 which are positioned at the ends of the array of the discharge pipes 62 may have only one such discharge port 61. Therefore, the mist is discharged transversely or laterally into the cooled air passage 4 so that it will be dispersed fully across the cooled air passage 4 and uniformaly discharged through the outlet 10.

An ultrasonic humidifier unit optimum for use as a humidifier on refrigerated display cabinets will be described with reference to FIGS. 14 through 18. The ultrasonic humidifier is highly durable and can be operated throughout the year irrespectively of the seasons.

Figure 16:
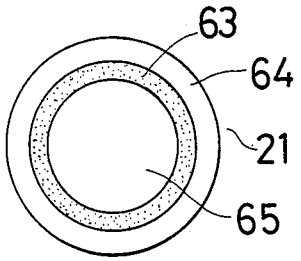
FIG. 16 is a bottom view of an ultrasonic vibrator of the humidifier unit of FIG. 9.
Figure 17:
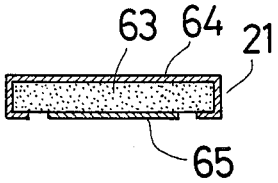
FIG. 17 is a vertical cross-sectional view of the ultrasonic vibrator.

As shown in FIGS. 16 and 17, the ultrasonic vibrator 21 comprises an vibrator body 63 made of lead titanate or lead zirconate porcelain, an electrode 64 extending from one side to the other across an entire peripheral edge, and another electrode 65 on the other side with an annular gap defined between the electrodes 64, 65. The electrodes 64, 65 are formed by plating the surfaces of the vibrator body 63 with Ni.

The ultrasonic vibrator 21 is supported obliquely by a cylindrical rubber support 66 which also serves to prevent a water leakage through the hole 22. The support 66 is supported by an attachment base 67 of synthetic resin which is secured to the lower surface of the bottom of the atomizing water tank 19 by fasteners 69 such as bolts and nuts, for example, with spacers 68 interposed between the water tank bottom and the attachment base 67.

A cooling plate 70 made of a metal of high thermal conductivity such as aluminum is secured to a front side wall of the atomizing water tank 19 by fastener (71) such as bolts and nuts. To a lower end of the cooling plate 70, there is secured by screws 73 a circuit board 72 supporting circuit components of an ultrasonic oscillator 23 for actuating the ultrasonic vibrator 21 to atomize water. A transistor 74 which is an excitation output element of the oscillator 23 is attached by a screw 75 to the cooling plate 70 at one end thereof in spaced relation to the circuit board 72. An insulator 76 of thermal conductivity such as in the form of built-up mica is interposed between the transistor 74 and the cooling plate 70, so that the transistor 74 is insulated from the wall of the atomizing water tank 19.

Figure 18:
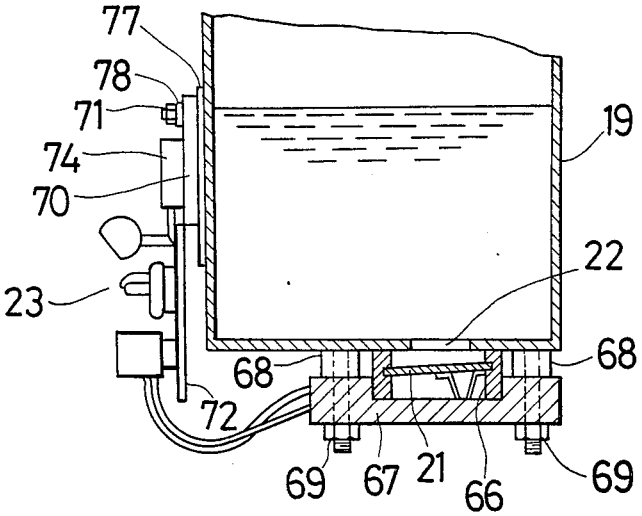
FIG. 18 is a vertical cross-sectional view of a humidifier having an ultrasonic oscillator according to still another embodiment of the present invention.

FIG. 18 shows still another embodiment in which the transistor 74 is directly mounted on the cooling plate 70 with no insulator therebetween. The cooling plate 70 is attached to the front wall of the atomizing water tank 19 with an insulator 77 of thermal conductivity such as in the form of built-up mica interposed therebetween. The fasteners 71 such as bolts and nuts are insulated from the cooling plate 70 by insulating collars 78 fitted over the fasteners 71.

The ultrasonic oscillator 23 will not be described in detail since it is of a known circuit arrangement. The ultrasonic oscillator 23 has the problem of interfering with radio receivers and the like at high frequencies unless the ultrasonic oscillator 23 is grounded. However, such a drawback can be eliminated by using a filter circuit.

With the illustrated ultrasonic humidifier, the atomizing water tank 19 is made of stainless steel sheet and the transistor 74 is cooled through the cooling plate 70 by the atomizing water tank 19. By making the transistor 74 nonconductive with respect to the wall of the atomizing water tank 19, the electrode 64 of the ultrasonic vibrator 21 which is held in contact with water is not subjected to any substantially appreciable electrochemical corrosion after 8,000 through 10,000 hours of operation. Therefore, the ultrasonic humidifier of the invention has a greatly increased degree of durability.

Although certain preferred embodiments have been shown and described, it should be understood that many changes and modifications may be made therein without departing from the scope of the appended claims.

What is claimed is:

1. A refrigerated display cabinet comprising a heat insulating wall having one open side and an inner wall surface, a partition defining a storage chamber, said inner wall surface and said partition jointly defining a cooled air passage, a refrigerating unit and an air blower disposed in said cooled air passage, said cooled air passage including an outlet and inlet confronting each other and disposed upwardly and downardly of said one open side, a humidifier unit mounted on an upper surface of said heat insulating wall, said humidifier unit including an ultrasonic vibrator for generating a mist, and a pipe for delivering said mist generated by said humidifier unit into said cooled air passage, said humidifier unit further comprising a body adapted to be mounted on an upper surface of the refrigerated display cabinet, a horizontally elongate atomizing water tank disposed in one side of said body and having a plurality of ultrasonic vibrators mounted on a bottom thereof and arrayed in a transverse direction thereof, an air blower disposed in an opposite side of said body for supplying air drawn from a suction port into said atomizing water tank, and pipes angularly movably mounted on said atomizing water tank in coaction with said ultrasonic vibrators, respectively, for transferring said mist generated by said ultrasonic vibrators in said atomizing water tank and air from said air blower into the cooled air passage of said refrigerated display cabinet, all of said pipes together constituting said pipe for delivering said mist.

2. A refrigerated display cabinet according to claim 1, wherein said atomizing water tank includes a wall having a horizontally elongate air inlet port disposed in confronting relation to a discharge port of said air blower of the humidifier unit and positioned upwardly of lower open ends of said pipes, said air inlet port of said atomizing water tank having end portions wider than a central portion thereof.

3. A refrigerated display cabinet according to claim 1, wherein said pipes comprise a plurality of outlet pipes mounted in coaction with said ultrasonic vibrators, respectively, for transferring a mist generated by said ultrasonic vibrators in said atomizing water tank and air from said air blower out of said atomizing water tank, communicating pipes having ends connected to said outlet pipes, respectively, and opposite ends connected to the cooled air passage of the refrigerated display cabinet, and wherein said atomizing water tank has a lid plate closing an upper opening thereof, said outlet pipes comprising bent pipes having connector mouths opening laterally and angularly movably extending through said lid plate.

4. A refrigerated display cabinet according to claim 3, wherein said lid plate has circular holes in which lower ends of said outlet pipes are fitted, said outer pipes having annular ridges around outer peripheral surfaces thereof, futher including seal gaskets fitted around said outlet pipes respectively and sandwiched between said annular ridges and upper surfaces of said lid plate around said circular holes, and a retaining plate fixed to said lid plate for preventing said outer pipes from being removed.

5. A humidifier unit according to claim 3, wherein said atomizing water tank comprises a stainless steel sheet, and said humidifier unit further comprises a cooling plate fixed to an outer surface of a wall of said atomizing water tank, an ultrasonic oscillator for actuating said ultrasonic vibrators to atomize water in said atomizing water tank, and a circuit board supporting circuit components of said ultrasonic oscillator and fixed to said cooling plate, said circuit components including an oscillation output element fixed to said cooling plate in spaced relation to said circuit board and insulated from said wall of said atomizing water tank.

6. A refrigerated display cabinet according to claim 1, wherein said cooled air passage has an apertured straightening plate disposed transversely therein in the vicinity of said outlet and each end of said pipes has an outlet port opening in said cooled air passage in the vicinity of said straightening plate upstream thereof.

7. A refrigerated display cabinet according to claim 6, wherein said outlet port is open to discharge the mist transversely into the cooled air passage.

8. A refrigerated display cabinet according to claim 1, wherein said humidifier unit atomizing water tank comprises a bent stainless steel sheet, a cooling plate fixed to an outer surface of a wall of said atomizing water tank, an ultrasonic oscillator for actuating said ultrasonic vibrators to atomize water in said atomizing water tank, and a circuit board supporting circuit components of said ultrasonic oscillator and fixed to said cooling plate, said circuit components including an oscillation output element fixed to said cooling plate in spaced relation to said circuit board and insulated from said wall of said atomizing water tank.

* * * * *